US010808302B2

(12) United States Patent
Mizutani et al.

(10) Patent No.: US 10,808,302 B2
(45) Date of Patent: Oct. 20, 2020

(54) MAGNESIUM ALLOY

(71) Applicants: SUMITOMO ELECTRIC INDUSTRIES, LTD., Osaka-shi, Osaka (JP); NATIONAL UNIVERSITY CORPORATION UNIVERSITY OF TOYAMA, Toyama-shi, Toyama (JP)

(72) Inventors: Manabu Mizutani, Itami (JP); Katsuhito Yoshida, Itami (JP); Nozomu Kawabe, Itami (JP); Seiji Saikawa, Toyama (JP)

(73) Assignees: SUMITOMO ELECTRIC INDUSTRIES, LTD., Osaka-shi, Osaka (JP); NATIONAL UNIVERSITY CORPORATION UNIVERSIT OF TOYAMA, Toyama-shi, Toyama (JP)

( * ) Notice: Subject to any disclaimer, the term of this patent is extended or adjusted under 35 U.S.C. 154(b) by 0 days.

(21) Appl. No.: 15/779,971

(22) PCT Filed: Jul. 13, 2017

(86) PCT No.: PCT/JP2017/025598
§ 371 (c)(1),
(2) Date: May 30, 2018

(87) PCT Pub. No.: WO2018/012602
PCT Pub. Date: Jan. 18, 2018

(65) Prior Publication Data

US 2018/0371583 A1 Dec. 27, 2018

(30) Foreign Application Priority Data

Jul. 15, 2016 (JP) ..... 2016-140004

(51) Int. Cl.
*C22C 23/02* (2006.01)
*C22C 23/00* (2006.01)

(52) U.S. Cl.
CPC ..... *C22C 23/02* (2013.01); *C22C 23/00* (2013.01)

(58) Field of Classification Search
CPC ..... C22C 23/02; C22C 23/00
(Continued)

(56) References Cited

U.S. PATENT DOCUMENTS 5,147,603 A 9/1992 Nussbaum et al.
9,180,515 B2 * 11/2015 Okamoto ..... C22F 1/06
(Continued)

FOREIGN PATENT DOCUMENTS

CN 102776427 A 11/2012
DE 69104784 T2 3/1995
(Continued)

OTHER PUBLICATIONS

Freidrich, et al., "Magnesium Technology", pp. 80, 93, 94, 119-121, 150 and 167.

*Primary Examiner* — Anthony J Zimmer
*Assistant Examiner* — Ricardo D Morales
(74) *Attorney, Agent, or Firm* — Faegre Drinker Biddle & Reath LLP

(57) ABSTRACT

A magnesium alloy is provided that includes: 5.0 mass % or more and 15.0 mass % or less of Al; 2.5 mass % or more and 7.0 mass % or less of Sr; 0.05 mass % or more and less than 3.0 mass % of Ca; and 0.1 mass % or more and 0.6 mass % or less of Mn, with a remainder including Mg and inevitable impurities.

13 Claims, 1 Drawing Sheet

(58) Field of Classification Search
USPC ..... 420/410
See application file for complete search history.

(56) References Cited

U.S. PATENT DOCUMENTS

| | | | | |
|---|---|---|---|---|
| 2005/0095166 | A1* | 5/2005 | Saikawa | C22C 23/02 420/407 |
| 2008/0219880 | A1* | 9/2008 | Bronfin | B22D 21/007 420/405 |
| 2011/0220251 | A1 | 9/2011 | Okamoto et al. | |
| 2014/0044586 | A1 | 2/2014 | Hirai et al. | |

FOREIGN PATENT DOCUMENTS

| | | | | |
|---|---|---|---|---|
| DE | 19915277 | A1 | | 10/2000 |
| DE | 10221720 | A1 | | 11/2003 |
| JP | 2010-242146 | A | | 10/2010 |
| JP | 2010242146 | A | * | 10/2010 |
| JP | 2012-136727 | A | | 7/2012 |
| JP | 2013-007068 | A | | 1/2013 |
| KR | 10-2009-0062749 | A | | 6/2009 |
| WO | WO-2005/108634 | A1 | | 11/2005 |
| WO | WO 2010/055897 | A1 | | 5/2010 |
| WO | WO 2012/133522 | A1 | | 10/2012 |

* cited by examiner

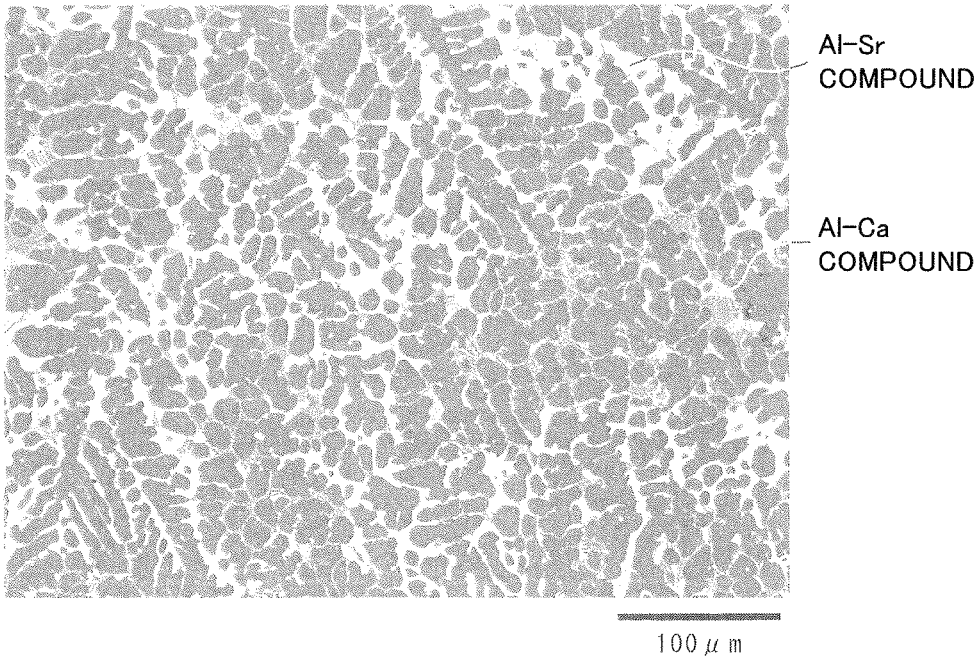
Al-Sr
COMPOUND
Al-Ca
COMPOUND
100 μm

MAGNESIUM ALLOY

TECHNICAL FIELD

The present invention relates to a magnesium alloy.

The present application claims priority based on Japanese Patent Application No. 2016-140004 filed on Jul. 15, 2016, and incorporates the entire description in the Japanese application.

BACKGROUND ART

Among practical metals, magnesium alloys have the lowest specific gravity and are excellent in specific strength and specific rigidity. Thus, magnesium alloys have attracted attention as light-weight materials. Such magnesium alloys contain various kinds of additional elements, thereby exhibiting various kinds of characteristics (for example, PTD 1 and PTD 2).

CITATION LIST

Patent Document

PTD 1: Japanese Patent Laying-Open No. 2012-136727
PTD 2: Japanese Patent Laying-Open No. 2010-242146

SUMMARY OF INVENTION

A magnesium alloy according to the present disclosure includes: 5.0 mass % or more and 15.0 mass % or less of Al; 2.5 mass % or more and 7.0 mass % or less of Sr; 0.05 mass % or more and less than 3.0 mass % of Ca; and 0.1 mass % or more and 0.6 mass % or less of Mn, with a remainder including Mg and inevitable impurities.

BRIEF DESCRIPTION OF DRAWINGS

FIG. 1 is a microphotograph showing a cross section of a die cast material of sample No. 1-17 produced in Experimental Example 1, which is observed by a scanning electron microscope (SEM).

DETAILED DESCRIPTION

Problem to be Solved by the Present Disclosure

Development of magnesium alloys that are excellent in heat resistance and also excellent in suppression of molten metal ignition has been desired.

Components such as automobile components and aircraft components may be used at an environment temperature higher than the room temperature. For example, since components disposed near the engine room may be used at an environment temperature of about 100° C. to about 180° C., it is desirable that these components are excellent in heat resistance. In particular, when these components are fastened to another component or an object to be installed with a bolt and the like, there is a possibility that the fastening state may be loosened by deformation over time. Thus, it is desirable that the fastening force (residual axial force) is less likely to decrease, that is, the high-temperature creep resistance is excellent.

These components are representatively formed of casting members. When such a casting member is manufactured, cover gas is generally used in order to suppress ignition of the molten metal of a magnesium alloy. When such cover gas is used, the component cost tends to increase, and molten metal handling tends to become complicated. Accordingly, it is desirable that a magnesium alloy is excellent in suppression of molten metal ignition.

Thus, an object is to provide a magnesium alloy that is excellent in heat resistance and also excellent in suppression of molten metal ignition.

Advantageous Effect of the Present Disclosure

The magnesium alloy of the present disclosure is excellent in heat resistance and also excellent in suppression of molten metal ignition.

DESCRIPTION OF EMBODIMENT OF THE PRESENT INVENTION

The present inventors have made an earnest study about the types and the contents of additional elements in order to manufacture a magnesium alloy that is excellent in heat resistance and also excellent in suppression of molten metal ignition. As a result, they found that a magnesium alloy that is excellent in heat resistance and also excellent in suppression of molten metal ignition can be achieved by applying aluminum (Al), strontium (Sr), calcium (Ca), and manganese (Mn) as additional elements, in which Ca is relatively small in amount while Sr is relatively large in amount. The present invention is based on the above-described findings. First, the contents of embodiments of the present invention will be listed and described below.

(1) A magnesium alloy according to one embodiment of the present invention includes: 5.0 mass % or more and 15.0 mass % or less of Al; 2.5 mass % or more and 7.0 mass % or less of Sr; 0.05 mass % or more and less than 3.0 mass % of Ca; and 0.1 mass % or more and 0.6 mass % or less of Mn, with a remainder including Mg and inevitable impurities.

The above-described configuration allows excellent heat resistance and excellent suppression of molten metal ignition. It is considered that this is because Ca is relatively small in amount while Sr is relatively large in amount, as will be described later in detail. Due to excellent heat resistance, suitable application to various types of materials made of a magnesium alloy can be realized. Due to excellent suppression of molten metal ignition, ignition of molten metal can be suppressed even if dissolution occurs in the atmosphere, so that the need for cover gas can be eliminated, and the manufacturing workability can be improved. No ignition of molten metal means that ignition does not occur in the stationary state at the representative molten metal temperature of a magnesium alloy. Details of each additional element will be described later.

(2) As one embodiment of the magnesium alloy, the magnesium alloy has a structure in which an area ratio of a compound containing Mg and Al in a cross section is 5% or less.

The compound containing Mg and Al has a relatively low melting point. Accordingly, when the area ratio of the compound is 5% or less, deterioration in heat resistance is readily suppressed.

(3) As one embodiment of the magnesium alloy, the magnesium alloy includes 0.5 mass % or more and 3.0 mass % or less of a rare earth element.

When the content of the rare earth element is 0.5 mass % or more, the compound containing aluminum and a rare earth element is allowed to exist in the alloy structure, so that the high-temperature creep resistance is readily improved.

When the content of the rare earth element is 3.0 mass % or less, an excessive increase of the compound containing aluminum and a rare earth element is suppressed, so that hot tear is readily suppressed.

(4) As one embodiment of the magnesium alloy, a total content of Sr and Ca is 6.0 mass % or less.

When the total content of Sr and Ca is 6.0 mass % or less, defects such as die sticking of a casting die and hot tear in a casting die are readily suppressed.

DETAILS OF EMBODIMENTS OF THE PRESENT INVENTION

The details of embodiments of the present invention will be hereinafter described.

[Magnesium Alloy]

A magnesium alloy according to an embodiment includes, as additional elements, specific amounts of Al, Sr, Ca, and Mn, with a remainder including Mg and inevitable impurities. One of the characteristics of this Mg alloy is that the content of Sr is relatively large and the content of Ca is relatively small, which will be described below in detail.

[Aluminum (Al)]

Al improves the high-temperature creep resistance. In addition, Al improves the mechanical characteristics such as corrosion resistance, strength, and plastic deformation resistance. Al forms a compound containing Sr (an Al—Sr compound), a compound containing Ca (an Al—Ca compound) and the like, and exists in the alloy structure. The details of each compound will be described later.

The content of Al is 5.0 mass % or more and 15.0 mass % or less. When the content of Al is 5.0 mass % or more, an Al—Sr compound and an Al—Ca compound are sufficiently readily formed, and the high-temperature creep resistance is readily improved. When the content of Al is 15.0 mass % or less, appropriate toughness can be achieved. Furthermore, since the compound containing Mg (an Mg—Al compound) is not excessively formed (deposited), decrease in high-temperature creep resistance is readily suppressed. It is further preferable that the content of Al is 6.0 mass % or more and 12.0 mass % or less. When the content of Al is 6.0 mass % or more, the melting point of the magnesium alloy decreases, thereby improving the flowability, so that the castability is readily improved. When the content of Al is 12.0 mass % or less, formation of an Mg—Al compound is readily suppressed, and the heat resistance is further readily improved. It is particularly preferable that the content of Al is 8.0 mass % or more and 10.0 mass % or less. When the content of Al is 8.0 mass % or more and 10.0 mass % or less, excellent balance is achieved among the castability, the corrosion resistance, the strength, and the toughness.

[Strontium (Sr)]

Sr improves the high-temperature creep resistance and also improves the suppression of molten metal ignition. Due to improved suppression of molten metal ignition, ignition of the molten metal can be suppressed even if dissolution occurs in the atmosphere. Suppression of ignition of the molten metal means that ignition can be suppressed in the stationary state at a representative molten metal temperature of a magnesium alloy. The representative molten metal temperature of the magnesium alloy is about 660° C. or higher and about 750° C. or lower, for example. Accordingly, the need for cover gas can be eliminated and the manufacturing workability can be improved. Sr forms an Al—Sr compound and exists in the alloy structure. Due to such formation of an Al—Sr compound, formation (deposition) of an Mg—Al compound is suppressed.

The content of Sr is 2.5 mass % or more and 7.0 mass % or less. When the content of Sr is 2.5 mass % or more, an Al—Sr compound is sufficiently formed, and formation of an Mg—Al compound is readily suppressed, so that the high-temperature creep resistance is improved. In addition, the suppression of molten metal ignition is readily improved. As the content of Sr is higher, Al—Sr compounds are more sufficiently formed, and exist more in the grain boundary, so that grain boundary sliding and the like are readily suppressed, and the suppression of molten metal ignition is readily improved. When the content of Sr is 7.0 mass % or less, die sticking of the casting die is readily suppressed. It is further preferable that the content of Sr is 2.5 mass % or more and 5.0 mass % or less. When the content of Sr is 5.0 mass % or less, die sticking of the casting die can be reduced. It is particularly preferable that the content of Sr is 2.5 mass % or more and 4.0 mass % or less. When the content of Sr is 4.0 mass % or less, die sticking of the casting die can be further reduced without decreasing the heat resistance.

[Calcium (Ca)]

Ca improves the high-temperature creep resistance. Ca forms an Al—Ca compound and exists in the alloy structure. Due to such formation of an Al—Ca compound, formation (deposition) of an Mg—Al compound is suppressed.

The content of Ca is 0.05 mass % or more and less than 3.0 mass %. When the content of Ca is 0.05 mass % or more, an Al—Ca compound is sufficiently formed and formation of an Mg—Al compound is readily suppressed, so that the high-temperature creep resistance is readily improved. As the content of Ca is higher, Al—Ca compounds are more sufficiently formed like Sr, and exist more in the grain boundary, so that grain boundary sliding and the like are readily suppressed. When the content of Ca is less than 3.0 mass %, it becomes possible to readily suppress that excessive existence of Al—Ca compounds causes defects such as hot tear, and also possible to improve the castability. It is further preferable that the content of Ca is 0.5 mass % or more and 2.0 mass % or less. When the content of Ca is 0.5 mass % or more, an Al—Ca compound is formed to improve the heat resistance, and also, the suppression of molten metal ignition is readily improved. It is particularly preferable that the content of Ca is 0.5 mass % or more and 1.5 mass % or less. When the content of Ca is 1.5 mass % or less, occurrence of defects such as hot tear can be suppressed without deteriorating the heat resistance and the suppression of molten metal ignition.

[Manganese (Mn)]

Mn improves the high-temperature creep resistance. In addition, Mn decreases Fe that may exist as impurities in a magnesium alloy and contributes also to improvement in corrosion resistance. Mn forms a compound containing Al (an Al—Mn compound) and suppresses formation (deposition) of an Mg—Al compound.

The content of Mn is 0.1 mass % or more and 0.6 mass % or less. When the content of Mn is 0.1 mass % or more, an Al—Mn compound is readily sufficiently formed, and formation (deposition) of an Mg—Al compound is readily suppressed. In addition, the corrosion resistance is readily improved. The above-described effect is saturated when the content of Mn is about 0.6 mass %. It is further preferable that the content of Mn is 0.2 mass % or more and 0.4 mass % or less. When the content of Mn is 0.2 mass % or more and 0.4 mass % or less, the amount of Fe as impurities deteriorating the corrosion resistance can be reduced. It is particularly preferable that the content of Mn is 0.2 mass % or more and 0.3 mass % or less. When the content of Mn is 0.2 mass % or more and 0.3 mass % or less, generation of bulky and coarse Al—Mn compounds can be reduced without deteriorating the effect of reducing the amount of Fe as impurities. Accordingly, the corrosion resistance can be improved without adversely affecting the heat resistance and the mechanical characteristics.

[Rare Earth Element (RE)]

RE improves the high-temperature creep resistance. RE forms a compound containing Al (an Al-RE compound), and exists in the alloy structure. Due to such formation of an Al-RE compound, formation (deposition) of an Mg—Al compound is suppressed. RE is at least one kind of rare earth element selected from group III elements in the periodic table, that is, from scandium (Sc), yttrium (Y), lanthanoid, and actinoid, and also includes misch metal that is an alloy containing a plurality of kinds of rare earth elements.

The content of RE is 0.5 mass % or more and 3.0 mass % or less. When the content of RE is 0.5 mass % or more, Al-RE compounds are sufficiently formed, and exist more in the grain boundary, so that grain boundary sliding and the like are readily suppressed. When the content of RE is 3.0 mass % or less, it becomes possible to suppress that excessive existence of Al-RE compounds causes defects such as hot tear. It is further preferable that the content of RE is 0.5 mass % or more and 2.0 mass % or less. When the content of RE is 2.0 mass % or less, the heat resistance is improved while hot tear can be reduced. It is particularly preferable that the content of RE is 0.5 mass % or more and 1.5 mass % or less. When the content of RE is 1.5 mass % or less, the heat resistance can be sufficiently improved. In addition, the amount of expensive rare earth elements to be used can be reduced, so that the alloy cost can be reduced.

[Sr+Ca]

It is preferable that the total content of Sr and Ca is 3.0 mass % or more. When this total content is 3.0 mass % or more, the high-temperature creep resistance is readily effectively improved. It is preferable that the total content of Sr and Ca is 6.0 mass % or less. When this total content is 6.0 mass % or less, defects such as die sticking of a casting die and hot tear in a casting die are readily effectively suppressed. The total content of Sr and Ca is further preferably 3.0 mass % or more and 5.0 mass % or less, and particularly preferably 3.5 mass % or more and 4.5 mass % or less. It is preferable that as the content of Al is higher, the total content of Sr and Ca is higher in the above-described range. In this way, even if the content of Al is relatively high, an Al—Sr compound and an Al—Ca compound are formed, and formation of an Mg—Al compound is readily effectively suppressed.

It is preferable that the content ratio of Sr and Ca is 2:1 to 5:1, for example. In this way, the effect of improving the high-temperature creep resistance and the effect of suppressing defects such as die sticking of a casting die and hot tear in a casting die are readily achieved in excellent balance. It is particularly preferable that the content ratio of Sr and Ca is about 3:1.

[Structure]

A magnesium alloy has a structure in which at least one of the Al—Sr compound and the Al—Ca compound described above, representatively, both the Al—Sr compound and the Al—Ca compound, are dispersed in the grain boundary. When a magnesium alloy contains RE as an additional element, Al-RE compounds also dispersedly exist in the grain boundary like the Al—Sr compound and the Al—Ca compound. This magnesium alloy has a structure containing a small number of Mg—Al compounds or containing substantially no Mg—Al compound.

Such an Al—Sr compound, an Al—Ca compound and an Al-RE compound are representatively crystallized products. The melting points of the Al—Sr compound and the Al—Ca compound are 1000° C. or higher, and the melting point of the Al-RE compound is 1100° C. or higher, which are sufficiently higher than the melting point of the Mg—Al compound (462° C.). It is considered that high-melting point compounds such as an Al—Sr compound, an Al—Ca compound and an Al-RE compound dispersedly exist in the grain boundary, and low-melting point compounds such as an Mg—Al compound are few in number, so that grain boundary sliding and the like can be suppressed even when kept at a high temperature, with the result that creep deformation can be less likely to occur.

The types of Al—Sr compounds may be $Al_2Sr$, $Al_4Sr$, $Mg_{13}Al_3Sr$, $Mg_{11}Al_3Sr$, $Mg_9Al_3Sr$, and the like, for example. The types of Al—Ca compounds may be $Al_2Ca$, $Al_4Ca$, $(MgAl)_2Ca$, and the like, for example. The types of Al-RE compounds may be $Al_2RE$, $Al_{11}RE_3$, and the like, for example. The types of Mg—Al compounds may be $Mg_{17}Al_{12}$, and the like, for example. The compositions of these compounds can be confirmed by conducting componential analysis, for example, by energy dispersive X-ray spectrometry (EDX), Auger electron spectroscopy (AES), and the like.

The structure containing a small number of Mg—Al compounds or containing substantially no Mg—Al compound means a structure in which the area ratio of Mg—Al compounds in the cross section of a magnesium alloy is quantitatively 5% or less. As the area ratio is smaller, the high-temperature creep resistance becomes more excellent, and defects such as hot tear as described above can be suppressed more. The area ratio is preferably 4% or less, and further preferably 2% or less. It is most preferable that the area ratio is 0%, that is, no Mg—Al compound exists.

The method of measuring the area ratio is as described below. Using a microphotograph of the cross section of a magnesium alloy, Mg—Al compounds (mainly $Mg_{17}Al_{12}$) existing in an observation field Sf (350 μm×250 μm) are extracted to calculate the areas thereof, and further calculate a total area Sm thereof. Then, (Sm/Sf)×100% is calculated as an area ratio of the Mg—Al compound in the cross section, and the average of the area ratios in 10 observation fields is defined as an area ratio (%). Extraction of the cross section can be performed using a commercially available cross section polisher (CP) processing apparatus. The cross-section area of the Mg—Al compound can be readily measured by utilizing a binarized image or the like obtained by binarization-processing a microphotograph (SEM image) by an image processing apparatus. Binarization-processing can be accomplished by distinguishing the Mg—Al compound from a mother phase and other compounds by the difference in color tones. At this time, the types of the mother phase and each of other compounds can be checked by conducting point analysis by EDX.

[Usage]

A magnesium alloy according to an embodiment can be suitably utilized for materials of various casting members.

[Functions and Effects]

In accordance with the magnesium alloy according to the embodiment, the following effects can be achieved.

(1) Excellent heat resistance. Therefore, the magnesium alloy according to the embodiment can be suitably utilized for materials of various casting members of a magnesium alloy.

(2) Excellent suppression of molten metal ignition. Therefore, since ignition of the molten metal can be suppressed even if dissolution occurs in the atmosphere, the need for cover gas can be eliminated, so that the manufacturing workability of various casting members of a magnesium alloy can be improved.

(3) Die sticking of a casting die is less likely to occur. Therefore, the manufacturing workability of various casting members of a magnesium alloy can be improved.

(4) Defects such as hot tear are less likely to occur. Therefore, the magnesium alloy according to the embodiment can be suitably utilized for materials of various casting members of a magnesium alloy having an excellent external appearance.

Experimental Example 1

A die cast material was produced using a magnesium alloy. The heat resistance, cracking and die sticking performance of the die cast material were evaluated. The manufacturing conditions of the magnesium alloy of the present invention are not necessarily limited to the manufacturing conditions of the die cast material as described below.

Molten metal of a magnesium alloy was produced. First, 50 kg mass of magnesium of 99.9 mass % in purity was prepared, and then dissolved at 690° C. in a melting furnace of an Ar atmosphere, to produce molten metal of pure magnesium. Then, masses of additional elements 1 to 5 listed below were added to the molten metal of completely dissolved pure magnesium, to produce molten metals of magnesium alloys having compositions shown in Tables 1 to 4. The symbol "–" in Tables 1 to 4 indicates that no additional element is contained. Addition and dissolution of the additional elements were conducted while performing stirring for 10 minutes using a rod-shaped jig in the state where the temperature of the molten metal was kept at 690° C.

1. Pure aluminum mass of 99.9 mass % in purity
2. Sr mass of 99 mass % in purity
3. Ca mass of 99.5 mass % in purity
4. Aluminum mother alloy (Al-10 mass % of Mn)
5. Misch metal mass of 99 mass % in purity The elements contained in misch metal and the contents thereof are as follows: La is 28 mass %, Ce is 51 mass %, Nd is 16 mass %, and Pr is 5 mass %.

The die cast material was produced using magnesium alloy molten metal of each produced sample. The die cast material was produced using a cold chamber die cast machine (model number UB530iS2 manufactured by Ube Machinery Corporation, Ltd.). In this case, the casting conditions were set at a molten metal temperature of 690° C., at an injection speed of 2.5 m/s, and with a casting pressure of 60 MPa. The die cast material was formed to have a ring shape.

[Observation of Cross Section]

The area ratio of the Mg—Al compound (mainly $Mg_{17}Al_{12}$) in the cross section of the die cast material of each of the produced samples was calculated. Extraction of each cross section was performed using a commercially available cross section polisher (CP) processing apparatus. Each cross section was observed using an SEM. The area ratio of the Mg—Al compound was calculated in the following manner. Using an SEM photograph, Mg—Al compounds (mainly $Mg_{17}Al_{12}$) existing in observation field Sf (350 μm×250 μm) were extracted, and a total area Sm thereof was calculated. Then, (Sm/Sf)×100% was defined as an area ratio of the Mg—Al compound in its cross section. Assuming that the number of observation fields was 10, the average of the area ratios in these 10 observation fields was defined as an area ratio (%) of the Mg—Al compound in each sample. The results thereof are shown in Tables 1 to 4. The cross-section area of the Mg—Al compound can be readily measured by utilizing a binarized image or the like obtained by binarization-processing a microphotograph (SEM image) by an image processing apparatus.

By way of example, FIG. 1 shows a microphotograph of sample No. 1-17. In FIG. 1, the portions shown in deep gray indicate a mother phase of the magnesium alloy, the portions shown in light gray indicate Al—Ca compounds, and the portions shown in white indicate Al—Sr compounds. As shown in FIG. 1, it turns out that, in sample No. 1-17 containing Al, Sr, Ca, and Mn in specific ranges, Al—Sr compounds and Al—Ca compounds dispersedly exist in the grain boundary. Furthermore, in sample No. 1-17, Mg—Al compounds cannot be confirmed and do not substantially exist.

[Evaluation of Heat Resistance]

The heat resistance of the die cast material of each produced sample was evaluated. This evaluation was performed as follows. Specifically, heat treatment was performed for the test member obtained by fastening a die cast material of each sample and a block material made of aluminum with an iron bolt, and then, the residual axial force (%) was calculated based on the distortion amount of the bolt before and after the heat treatment. The test member was fabricated by tightening the iron bolt while aligning a hole in the die cast material of each sample with a bolt hole provided at an appropriate position in the block material and having the same diameter as that of the hole in the die cast material of each sample. The heat treatment was conducted under the conditions at a temperature of 150° C. and for a retention time of 170 hours. The distortion amount was obtained by a commercially available strain gauge placed in the bolt. The residual axial force was calculated according to [(St−So)/So]×100(%) assuming that the distortion amount of the bolt immediately after tightening and before heating to 150° C. was defined as So, and the distortion amount of the bolt after subjected to thermal hysteresis of 150° C.×170 hours was defined as St. Distortion amount So before heating was defined as a distortion amount obtained when the bolt was tightened with an initial tightening axial force of 9N. The results of the residual axial force and evaluations A to C are shown in Tables 1 to 4. Evaluation A indicates that the residual axial force was 50% or more; evaluation B indicates that the residual axial force was 40% or more and less than 50%; and evaluation C indicates that the residual axial force was less than 40%. The symbol "*" shown in Table 4 indicates that measurement could not be performed due to occurrence of cracking.

[Evaluation of Cracking]

The state of cracking in the die cast material of each produced sample was evaluated. Such evaluation of the state of cracking was performed by visually confirming the surface of the die cast material of each sample to check the occurrence frequency of cracking. The occurrence frequency of cracking was defined as an average number of cracks in 10 die cast materials prepared for each of samples. The results of the occurrence frequency of cracking (number) and evaluations A to C thereof are shown in Tables 1 to 4. Evaluation A indicates that the occurrence frequency of cracking was 0; evaluation B indicates that the occurrence frequency of cracking was more than 0 and 5 or less; and evaluation C indicates that the occurrence frequency of cracking was more than 5.

[Evaluation of Die Sticking Performance]

The die sticking performance of the die cast material of each of the produced samples was evaluated. Similar to evaluation of cracking, this evaluation of die sticking performance was carried out by visually confirming the surface of the die cast material of each sample to check the number of portions where die sticking occurred. The number of portions where die sticking occurred was defined as an average number of portions where die sticking occurred in 10 die cast materials prepared for each sample. The results of the number of portions where die sticking occurred (portions) and evaluations A to C thereof are shown in Tables 1 to 4. Evaluation A indicates that the number of portions where die sticking occurred was 0; evaluation B indicates that the number of portions where die sticking occurred was more than 0 and 5 or less; and evaluation C indicates that the number of portions where die sticking occurred was more than 5.

[Comprehensive Evaluation]

Table 1 shows the results of the comprehensive evaluation about three evaluations for heat resistance, cracking, and die sticking performance. Comprehensive evaluation A indicates that all of three evaluations for heat resistance, cracking and die sticking performance were A; comprehensive evaluation B indicates that at least one of three evaluations was B and none of three evaluations was C; and comprehensive evaluation C indicates that at least one of three evaluations was C.

TABLE 1

| Sample No. | Al (Mass %) | Sr (Mass %) | Ca (Mass %) | Mn (Mass %) | RE (Mass %) | Sr + Ca (Mass %) | $Mg_{17}Al_{12}$ Area Ratio (%) |
|---|---|---|---|---|---|---|---|
| 1-1 | 6.1 | 2.8 | 0.7 | 0.26 | — | 3.5 | 0 |
| 1-2 | 6.5 | 4.0 | 0.5 | 0.25 | — | 4.5 | 0 |
| 1-3 | 6.2 | 3.3 | 1.5 | 0.25 | — | 4.8 | 0 |
| 1-4 | 6.1 | 2.6 | 1.8 | 0.25 | — | 4.4 | 0 |
| 1-5 | 7.2 | 3.1 | 0.9 | 0.25 | — | 4.0 | 0 |
| 1-6 | 6.8 | 2.6 | 1.8 | 0.27 | — | 4.4 | 0 |
| 1-7 | 7.0 | 3.8 | 1.0 | 0.24 | — | 4.8 | 0 |
| 1-8 | 7.3 | 4.0 | 0.6 | 0.24 | — | 4.6 | 0 |
| 1-9 | 7.1 | 3.0 | 1.5 | 0.25 | — | 4.5 | 0 |
| 1-10 | 7.9 | 4.0 | 0.6 | 0.25 | — | 4.6 | 1 |
| 1-11 | 8.3 | 2.6 | 1.5 | 0.30 | — | 4.1 | 0 |
| 1-12 | 8.2 | 4.2 | 0.5 | 0.24 | — | 4.7 | 2 |
| 1-13 | 8.5 | 3.2 | 1.0 | 0.25 | — | 4.2 | 0 |
| 1-14 | 9.3 | 2.5 | 1.5 | 0.23 | — | 4.0 | 0 |
| 1-15 | 9.2 | 4.0 | 0.6 | 0.25 | — | 4.6 | 3 |
| 1-16 | 9.1 | 3.1 | 1.8 | 0.25 | — | 4.9 | 0 |
| 1-17 | 9.3 | 3.3 | 1.5 | 0.29 | — | 4.8 | 0 |

| Sample | Residual Axial Force | | Occurrence Frequency of Cracking | | Die Sticking | | Comprehensive |
|---|---|---|---|---|---|---|---|
| No. | (%) | Evaluation | (Number) | Evaluation | (Portions) | Evaluation | Evaluation |
| 1-1 | 63 | A | 0 | A | 0 | A | A |
| 1-2 | 62 | A | 0 | A | 0 | A | A |
| 1-3 | 73 | A | 0 | A | 0 | A | A |
| 1-4 | 70 | A | 0 | A | 0 | A | A |
| 1-5 | 62 | A | 0 | A | 0 | A | A |
| 1-6 | 70 | A | 0 | A | 0 | A | A |
| 1-7 | 61 | A | 0 | A | 0 | A | A |
| 1-8 | 60 | A | 0 | A | 0 | A | A |
| 1-9 | 68 | A | 0 | A | 0 | A | A |
| 1-10 | 59 | A | 0 | A | 0 | A | A |
| 1-11 | 64 | A | 0 | A | 0 | A | A |
| 1-12 | 57 | A | 0 | A | 0 | A | A |
| 1-13 | 63 | A | 0 | A | 0 | A | A |
| 1-14 | 69 | A | 0 | A | 0 | A | A |
| 1-15 | 58 | A | 0 | A | 0 | A | A |
| 1-16 | 72 | A | 0 | A | 0 | A | A |
| 1-17 | 66 | A | 0 | A | 0 | A | A |

TABLE 2

| Sample No. | Al (Mass %) | Sr (Mass %) | Ca (Mass %) | Mn (Mass %) | RE (Mass %) | Sr + Ca (Mass %) | $Mg_{17}Al_{12}$ Area Ratio (%) |
|---|---|---|---|---|---|---|---|
| 1-18 | 10.0 | 2.6 | 0.7 | 0.26 | — | 3.3 | 4 |
| 1-19 | 9.5 | 3.4 | 1.0 | 0.30 | — | 4.4 | 2 |
| 1-20 | 9.7 | 4.0 | 0.5 | 0.24 | — | 4.5 | 0 |
| 1-21 | 9.9 | 2.7 | 1.9 | 0.25 | — | 4.6 | 0 |
| 1-22 | 6.5 | 2.6 | 0.6 | 0.28 | 0.5 | 3.2 | 0 |
| 1-23 | 6.4 | 3.4 | 1.1 | 0.25 | 1.1 | 4.5 | 0 |
| 1-24 | 6.4 | 4.2 | 0.8 | 0.25 | 1.9 | 5.0 | 0 |
| 1-25 | 8.2 | 2.8 | 1.7 | 0.26 | 1.6 | 4.5 | 0 |

TABLE 2-continued

| | | | | | | | |
|---|---|---|---|---|---|---|---|
| 1-26 | 8.5 | 3.3 | 0.9 | 0.25 | 0.6 | 4.2 | 0 |
| 1-27 | 8.2 | 4.0 | 1.5 | 0.27 | 1.3 | 5.5 | 0 |
| 1-28 | 9.7 | 2.8 | 0.6 | 0.25 | 0.7 | 3.4 | 0 |
| 1-29 | 9.5 | 3.5 | 1.0 | 0.26 | 1.2 | 4.5 | 0 |
| 1-30 | 9.8 | 4.2 | 1.7 | 0.25 | 1.8 | 5.9 | 0 |
| 1-31 | 6.1 | 2.7 | 0.5 | 0.25 | — | 3.2 | 4 |
| 1-32 | 9.8 | 4.0 | 1.7 | 0.24 | — | 5.7 | 0 |
| 1-33 | 9.2 | 3.3 | 1.25 | 0.25 | 0.75 | 4.55 | 0 |
| 1-34 | 9.2 | 3.3 | 1.25 | 0.25 | 1.5 | 4.55 | 0 |

| Sample | Residual Axial Force | | Occurrence Frequency of Cracking | | Die Sticking | | Comprehensive |
|---|---|---|---|---|---|---|---|
| No. | (%) | Evaluation | (Number) | Evaluation | (Portions) | Evaluation | Evaluation |
| 1-18 | 57 | A | 0 | A | 0 | A | A |
| 1-19 | 67 | A | 0 | A | 0 | A | A |
| 1-20 | 57 | A | 0 | A | 0 | A | A |
| 1-21 | 65 | A | 0 | A | 0 | A | A |
| 1-22 | 65 | A | 0 | A | 0 | A | A |
| 1-23 | 68 | A | 0 | A | 0 | A | A |
| 1-24 | 66 | A | 0 | A | 0 | A | A |
| 1-25 | 68 | A | 0 | A | 0 | A | A |
| 1-26 | 65 | A | 0 | A | 0 | A | A |
| 1-27 | 70 | A | 0 | A | 0 | A | A |
| 1-28 | 58 | A | 0 | A | 0 | A | A |
| 1-29 | 68 | A | 0 | A | 0 | A | A |
| 1-30 | 76 | A | 0 | A | 0 | A | A |
| 1-31 | 54 | A | 0 | A | 0 | A | A |
| 1-32 | 74 | A | 0 | A | 0 | A | A |
| 1-33 | 50 | A | 0 | A | 0 | A | A |
| 1-34 | 55 | A | 0 | A | 0 | A | A |

TABLE 3

| Sample No. | Al (Mass %) | Sr (Mass %) | Ca (Mass %) | Mn (Mass %) | RE (Mass %) | Sr + Ca (Mass %) | $Mg_{17}Al_{12}$ Area Ratio (%) |
|---|---|---|---|---|---|---|---|
| 1-35 | 8.5 | 6.2 | 1.0 | 0.25 | — | 7.2 | 0 |
| 1-36 | 9.8 | 5.9 | 1.5 | 0.25 | — | 7.4 | 0 |
| 1-37 | 11.4 | 3.1 | 2.9 | 0.25 | — | 6.0 | 0 |
| 1-38 | 14.9 | 4.5 | 2.7 | 0.27 | — | 7.2 | 4 |
| 1-39 | 14.7 | 6.8 | 0.07 | 0.25 | — | 6.87 | 4 |
| 1-40 | 5.1 | 3.2 | 1.2 | 0.24 | — | 4.4 | 0 |
| 1-41 | 5.5 | 2.6 | 0.08 | 0.25 | — | 2.68 | 4 |
| 1-42 | 5.3 | 2.7 | 0.05 | 0.23 | 2.0 | 2.75 | 0 |
| 1-43 | 14.5 | 2.8 | 0.05 | 0.25 | — | 2.85 | 5 |

| Sample | Residual Axial Force | | Occurrence Frequency of Cracking | | Die Sticking | | Comprehensive |
|---|---|---|---|---|---|---|---|
| No. | (%) | Evaluation | (Number) | Evaluation | (Portions) | Evaluation | Evaluation |
| 1-35 | 74 | A | 0 | A | 4 | B | B |
| 1-36 | 79 | A | 0 | A | 3 | B | B |
| 1-37 | 82 | A | 4 | B | 0 | A | B |
| 1-38 | 65 | A | 3 | B | 1 | B | B |
| 1-39 | 41 | B | 0 | A | 5 | B | B |
| 1-40 | 48 | B | 0 | A | 0 | A | B |
| 1-41 | 45 | B | 0 | A | 0 | A | B |
| 1-42 | 49 | B | 0 | A | 0 | A | B |
| 1-43 | 45 | B | 0 | A | 0 | A | B |

TABLE 4

| Sample No. | Al (Mass %) | Sr (Mass %) | Ca (Mass %) | Mn (Mass %) | RE (Mass %) | Sr + Ca (Mass %) | $Mg_{17}Al_{12}$ Area Ratio (%) |
|---|---|---|---|---|---|---|---|
| 1-101 | 9.1 | 2.7 | — | 0.27 | — | — | 10 |
| 1-102 | 9.3 | 3.5 | — | 0.28 | — | — | 8 |
| 1-103 | 9.3 | 5.0 | 3.7 | 0.30 | — | 8.7 | 0 |
| 1-104 | 7.2 | 2.0 | 1.3 | 0.25 | — | 3.3 | 6 |
| 1-105 | 6.0 | 2.5 | — | 0.26 | — | — | 6 |

TABLE 4-continued

| | | | | | | | |
|---|---|---|---|---|---|---|---|
| 1-106 | 8.4 | — | 2.1 | 0.25 | — | — | 7 |
| 1-107 | 11.2 | 6.0 | 4.1 | 0.25 | 2.5 | 10.1 | 5 |
| 1-108 | 5.5 | 6.3 | 4.5 | 0.24 | 3.5 | 10.8 | 0 |
| 1-109 | 5.2 | 2.0 | — | 0.24 | 3.7 | — | 6 |
| 1-110 | 11.5 | — | 3.5 | 0.27 | 3.6 | — | 0 |
| 1-111 | 4.0 | — | — | 0.25 | 4.0 | — | 0 |
| 1-112 | 7.0 | 0.3 | 3.1 | 0.28 | — | 3.4 | 0 |
| 1-113 | 8.4 | 3.5 | — | 0.22 | 1.5 | — | 9 |
| 1-114 | 8.5 | 3.4 | — | 0.21 | 3.0 | — | 0 |
| 1-115 | 11.4 | 3.3 | 4.2 | 0.25 | — | 7.5 | 0 |
| 1-116 | 9.3 | 8.1 | 1.0 | 0.25 | — | 9.1 | 0 |
| 1-117 | 8.5 | 9.5 | 1.8 | 0.24 | — | 11.3 | 0 |

| Sample | Residual Axial Force | | Occurrence Frequency of Cracking | | Die Sticking | | Comprehensive |
|---|---|---|---|---|---|---|---|
| No. | (%) | Evaluation | (Number) | Evaluation | (Portions) | Evaluation | Evaluation |
| 1-101 | 33 | C | 0 | A | 0 | A | C |
| 1-102 | 35 | C | 0 | A | 0 | A | C |
| 1-103 | —* | C | 25 | C | 0 | A | C |
| 1-104 | 39 | C | 6 | C | 0 | A | C |
| 1-105 | 34 | C | 1 | B | 0 | A | C |
| 1-106 | 37 | C | 16 | C | 0 | A | C |
| 1-107 | 65 | A | 18 | C | 1 | B | C |
| 1-108 | 67 | A | 13 | C | 1 | B | C |
| 1-109 | 39 | C | 0 | A | 0 | A | C |
| 1-110 | —* | C | 8 | C | 0 | A | C |
| 1-111 | 57 | A | 9 | C | 0 | A | C |
| 1-112 | 55 | A | 16 | C | 0 | A | C |
| 1-113 | 35 | C | 0 | A | 0 | A | C |
| 1-114 | 39 | C | 0 | A | 0 | A | C |
| 1-115 | 80 | A | 8 | C | 0 | A | C |
| 1-116 | 65 | A | 0 | A | 8 | C | C |
| 1-117 | 69 | A | 0 | A | 13 | C | C |

As can be seen in Tables 1 to 3 showing sample No. 1-1 to sample No. 1-43 each including: 5 mass % or more and 15 mass % or less of Al; 2.5 mass % or more and 7 mass % or less of Sr; 0.05 mass % or more and less than 3.0 mass % of Ca; and 0.1 mass % or more and 0.6 mass % or less of Mn, these samples each exhibit high residual axial force, less cracking and less die sticking. It also turns out that sample No. 1-1 to sample No. 1-43 each contain an Mg—Al compound in a small area ratio, which is 5% or less. Particularly, as shown in Tables 1 and 2, in sample No. 1-1 to sample No. 1-34 each including: 6 mass % or more and 10 mass % or less of Al; 2.5 mass % or more and 5 mass % or less of Sr; 0.5 mass % or more and 2.0 mass % or less of Ca; and 0.1 mass % or more and 0.6 mass % or less of Mn, the residual axial force is 50% or more, the number of cracks is zero, and the number of portions where die sticking occurred is zero. Thus, it turns out that all of heat resistance, cracking and die sticking performance are excellent. On the other hand, as shown in Table 4, sample No. 1-101 to sample No. 1-117 each not having the above-described specific composition each exhibit small residual axial force, more cracking and more die sticking. Thus, it turns out that sample No. 1-101 to sample No. 1-117 are inferior in one or two of heat resistance, cracking and die sticking performance to sample No. 1-1 to sample No. 1-43. Furthermore, it turns out based on these samples that, as the content of Sr is higher, die sticking is more likely to occur, and also, as the content of Ca is higher, cracking is more likely to occur.

Experimental Example 2

The suppression of molten metal ignition of the magnesium alloy was evaluated. The suppression of molten metal ignition was evaluated by checking the ignition state of the molten metal of a magnesium alloy. First, the molten metal of a magnesium alloy having the same composition as those of sample No. 1-13 (Table 1) and sample No. 1-105 (Table 4) in Experimental Example 1 was produced in the same manner as in Experimental Example 1. Then, in the atmosphere, in the state where the molten metal was kept at a temperature of 700° C. for 1 hour without being stirred, the ignition state of the molten metal was checked.

The molten metal of the magnesium alloy of sample No. 1-13 did not ignite, whereas the molten metal of the magnesium alloy of sample No. 1-105 ignited. Based on this result, it turns out that the magnesium alloy containing Al, Sr, Ca, and Mn in specific ranges was excellent in suppression of molten metal ignition.

The present invention is defined by the terms of the claims, but not limited to the above description, and is intended to include any modifications within the meaning and scope equivalent to the terms of the claims.

The invention claimed is:

1. A magnesium alloy comprising:

8.1 mass % or more and 12.0 mass % or less of Al;

2.5 mass % or more and 4.2 mass % or less of Sr;

0.5 mass % or more and 2.0 mass % or less of Ca;

0.1 mass % or more and 0.3 mass % or less of Mn, with a remainder including Mg and inevitable impurities, wherein a total content of Sr and Ca is 3.2 mass % or more and 6.0 mass % or less.

2. The magnesium alloy according to claim 1, including a structure in which an area ratio of a compound containing Mg and Al in a cross section is 5% or less.

3. The magnesium alloy according to claim 1, further comprising:

0.5 mass % or more and 3.0 mass % or less of a rare earth element.

4. The magnesium alloy according to claim 1, wherein the total content of Sr and Ca is 3.5 mass % or more and 6.0 mass % or less.

5. The magnesium alloy according to claim 2, further comprising:

0.5 mass % or more and 3.0 mass % or less of a rare earth element.

6. The magnesium alloy according to claim 1, wherein the content of Al is 8.1 mass % or more and 10.0 mass % or less.

7. The magnesium alloy according to claim 1, wherein the content of Ca is 0.5 mass % or more and 1.5 mass % or less.

8. The magnesium alloy according to claim 5, wherein the content of Ca is 0.5 mass % or more and 1.5 mass % or less.

9. The magnesium alloy according to claim 6, wherein the content of Ca is 0.5 mass % or more and 1.5 mass % or less.

10. The magnesium alloy according to claim 1, wherein a die cast material of the magnesium alloy has a residual axial force of 50% or more.

11. The magnesium alloy according to claim 1, wherein a die cast material of the magnesium alloy does not crack.

12. The magnesium alloy according to claim 1, wherein a die cast material of the magnesium alloy does not stick.

13. The magnesium alloy according to claim 1, wherein a content ratio of Sr and Ca is 3:1 or more and 5:1 or less.

* * * * *